US005123141A

United States Patent [19]

Erickson et al.

[11] Patent Number: 5,123,141

[45] Date of Patent: Jun. 23, 1992

[54] CLEANING TOOL HAVING AIRFLOW DIRECTING MANIFOLD FOR A VACUUM CLEANER SYSTEM

[75] Inventors: Roy O. Erickson, Cadillac; Anthony T. Alexander, Clarkston; John J. Alberts, III, Marion, all of Mich.

[73] Assignee: Rexair, Inc., Cadillac, Mich.

[21] Appl. No.: 478,209

[22] Filed: Feb. 9, 1990

[51] Int. Cl.[5] ..... A47L 9/06

[52] U.S. Cl. ..... 15/373; 15/396; 15/398; 15/415.1

[58] Field of Search ..... 15/415 R, 418–419, 15/393, 396, 397, 398, 399, 400, 420, 416, 395, 414, 367, 373

[56] References Cited

U.S. PATENT DOCUMENTS

| | | | |
|---|---|---|---|
| 929,066 | 7/1909 | Williams | 15/415 R X |
| 1,110,439 | 9/1914 | Goughnour | 15/415 R X |
| 1,210,522 | 1/1917 | Orr | 15/414 X |
| 1,782,882 | 11/1930 | Rippey | 15/416 X |
| 2,283,428 | 5/1942 | Ellis | 15/416 |
| 2,296,462 | 9/1942 | Betts | 15/416 X |
| 2,528,278 | 10/1950 | Kendrick | 15/420 |
| 2,805,440 | 9/1957 | Hakanson | 15/415 R X |
| 2,842,793 | 7/1958 | Hurd | 15/416 X |
| 2,941,233 | 6/1960 | Prong | 15/398 |
| 3,360,816 | 1/1968 | Fontecchio | 15/415 R X |
| 3,835,869 | 9/1974 | Newman et al. | 15/400 X |
| 4,315,344 | 2/1982 | Woodward et al. | 15/345 |
| 4,333,205 | 6/1982 | Woodward et al. | 15/345 |
| 4,458,378 | 7/1984 | Helmes | 15/415 R |
| 4,637,086 | 1/1987 | Goode | 15/415 R X |
| 4,638,526 | 1/1987 | Murata et al. | 15/367 |

FOREIGN PATENT DOCUMENTS

| | | | |
|---|---|---|---|
| 880394 | 6/1953 | Fed. Rep. of Germany | 15/367 |
| 423493 | 4/1911 | France | 15/399 |

*Primary Examiner*—Chris K. Moore

*Attorney, Agent, or Firm*—Harness, Dickey & Pierce

[57] ABSTRACT

A cleaning tool for a vacuum cleaner system. The cleaning tool has a manifold disposed therein for more evenly distributing a vacuum-like force produced by the vacuum cleaner system to an undersurface of the cleaning tool, thereby increasing the number of dust and dirt particulates that can be picked up by the vacuum force, and thus increasing the efficiency of the cleaning tool. In a preferred embodiment, the cleaning tool comprises a multi-piece housing within which the manifold resides. The manifold includes a pair of outwardly flaring air passageways and is operable to selectively direct the vacuum force from a vacuum cleaner system more evenly across the undersurface of the cleaning tool to improve the pick-up of dust and dirt particles by the cleaning tool.

7 Claims, 3 Drawing Sheets

CLEANING TOOL HAVING AIRFLOW DIRECTING MANIFOLD FOR A VACUUM CLEANER SYSTEM

BACKGROUND OF THE INVENTION

1. Technical Field

This invention relates to vacuum cleaner systems and, more particularly, to a cleaning tool having an internal airflow directing manifold therein for use with a vacuum cleaner system.

2. Discussion

Vacuum cleaner systems are used in a variety of cleaning applications to clean a variety of upholstered objects and surfaces. To better accomplish this task, vacuum cleaner systems often employ a cleaning tool that attaches to a vacuum hose of the system. The undersurface of the cleaning tool typically comprises a cavity which helps directg and distribute the airflow developed by the vacuum system to the surface being cleaned.

The cleaning of most, if not all, surfaces would be improved, however, if such a cleaning tool were to incorporate an airflow direction device for directing the flow of the vacuum force produced by the vacuum cleaner system more evenly and uniformly across the undersurface of the cleaning tool. This would increase the effectiveness of the cleaning tool in picking up dust and dirt particles because the vacuum force produced by the vacuum cleaner system would be distributed more evenly and uniformly across the undersurface of the cleaning tool, thereby increasing the effectiveness of the vacuum force in lifting and removing dust and dirt particles from the surface being cleaned.

It would also be helpful if such a cleaning tool were to incorporate a pivot arm capable of enabling the cleaning tool to rotate slightly during use of the tool. This would allow the cleaning tool to be articulated more easily over non-planar surfaces and would further enhance the utility and ease of operation of the cleaning tool.

It is therefore a principal object of the present invention to provide a cleaning tool for a vacuum cleaner system, the cleaning tool having a device therein for selectively directing the vacuum force generated by the vacuum cleaner system more evenly across an undersurface of the tool.

It is also an object of the present invention to provide a cleaning tool operable to selectively direct a vaccuum force across an undersurface of the cleaning tool which can be relatively easily and inexpensively manufactured.

It is another object of the present invention to provide a cleaning tool for a vacuum cleaner system which is operable to rotate slightly durign use, thus further enhancing the utility and ease with which the cleaning tool may be operated.

SUMMARY OF THE INVENTION

In accordance with the preferred embodiment, a cleaning tool is disclosed for use in connection with a vacuum cleaning system. The cleaning tool comprises a main housing and a manifold assembly disposed within the main housing for evenly distributing the airflow produced by a vacuum cleaner system across an underside of the cleaning tool. The even distribution of the airflow across the underside of the cleaning tool helps facilitate pick-up of dust and dirt particulate matter by the cleaning tool from surfaces being cleaned.

In a preferred embodiment the cleaning tool also includes a pivot arm operable to connect with a vacuum hose of the vacuum cleaner system. The pivot arm enables the cleaning tool to rotate vertically in a partially arcuate path relative to the vacuum hose to thereby increase the utility and ease with which the cleaning tool may be used.

BRIEF DESCRIPTION OF THE DRAWINGS

The various advantages of the present invention will become apparent to one skilled in the art by reading the following specification and subjoined claims and by referencing the following drawings in which:

DESCRIPTION OF THE PREFERRED EMBODIMENTS

Figure 1:
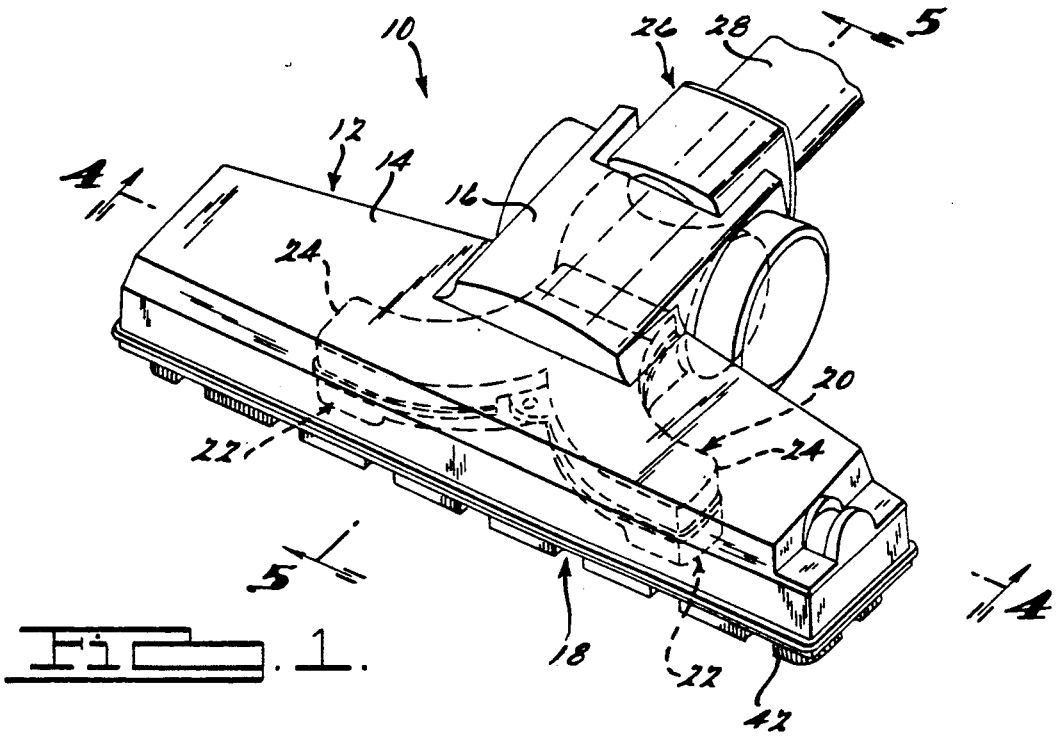
FIG. 1 is a perspective view of a cleaning tool in accordance with the present invention.

In FIG. 1 a cleaning tool 10 in accordance with the present invention is shown. The cleaning tool 10 generally includes a T-shaped main housing 12 having head and base portions 14 and 16 respectively, an undersurface 18, and a manifold assembly 20 contained within the housing 12. The manifold assembly 20 has openings 22 (shown more clearly in FIG. 2) at the outermost ends of independent, elongated, outwardly flaring air passegeways 24. A pivot arm assembly 26 resides nestably within the base portion 16 of the housing 12. An optional extension wand 28 is removably coupled to the pivot arm assembly 26 and a vacuum hose (not shown) of the system. The extension wand 28 and vacuum hose enable a suction-like vacuum force to be directed by a vacuum cleaner through the manifold assembly 20 to the undersurface 18 of the main housing 12.

In operation, as the cleaning tool 10 is traversed over a carpet or other surface to be cleaned, the manifold assembly 20 operates to more evenly distribute the suction-like vacuum force and airflow across the undersurface of the tool 18. The more evenly distributed vacuum force and airflow significantly improves the ability of the cleaning tool 10 to pick up dust and dirt prticles.

Figure 2:
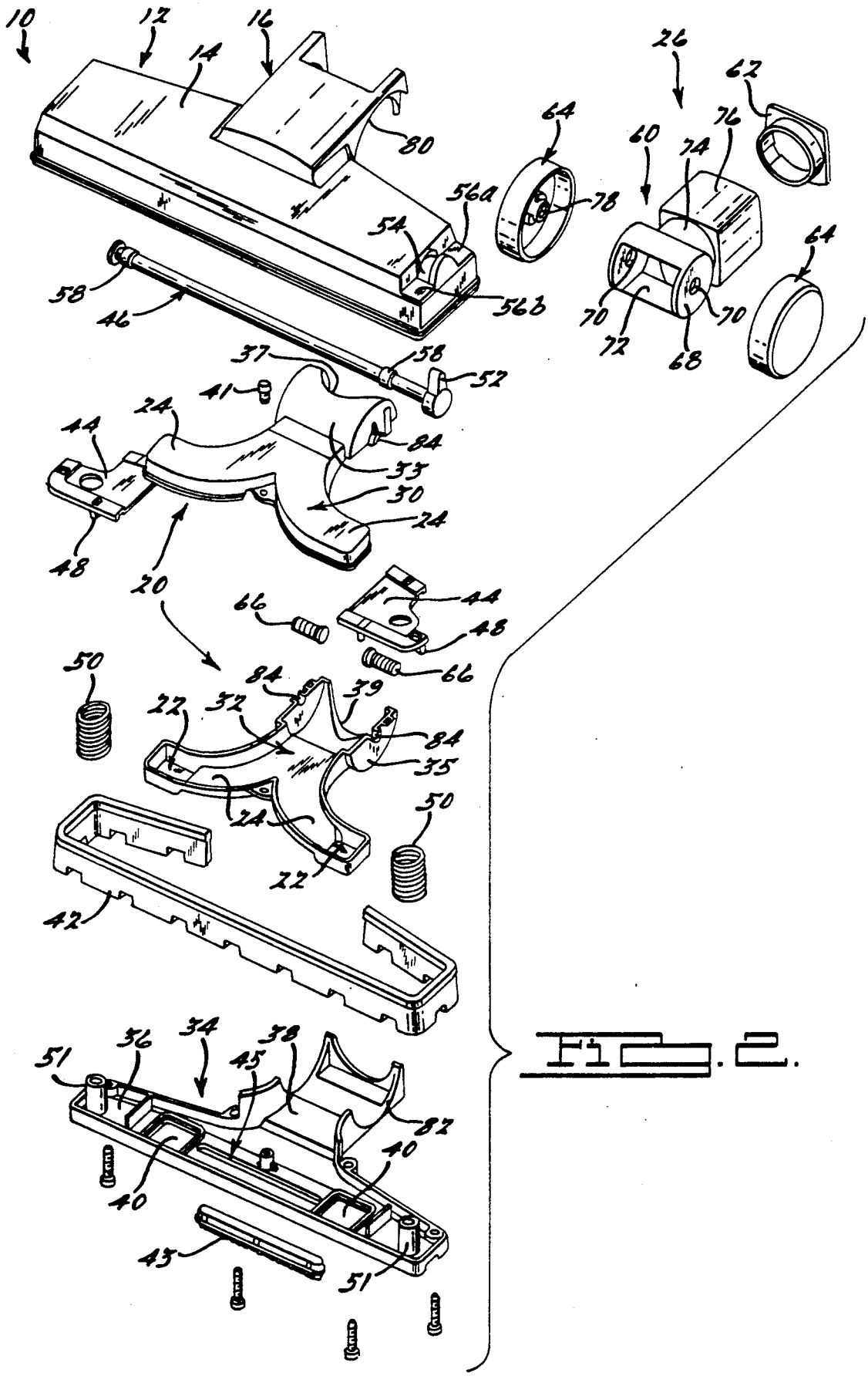
FIG. 2 is an exploded perspective view of the cleaning tool.

In FIG. 2 an exploded perspective view of the cleaning tool 10 is shown. The manifold assembly 20 is comprised of complimentary upper and lower manifold sections 30 and 32 respectively. The lower manifold section 32 includes openings 22 which form ports disposed at the outermost ends of the outwardly flaring air passageways 24. The manifold sections 30 and 32 further include enlarged, semi-annular coupling sections 33 and 35 having semi-annular openings 37 and 39 respectively. When the manifold sections 30 and 32 are assembled together, the coupling sections 33 and 35 and openings 37 and 39 form an enclosure within which a portion of the pivot arm assembly 26 may be rotatably housed. The openings 37 and 39 further provide an air passageway to allow a vacuum force to pass through the manifold assembly 20.

The manifold assembly 20 is adapted to rest nestably within a T-shaped lower sole plate 34 having head and base portions 36 and 38, respectively, and is secured thereto by a screw 41. When attached to the sole plate 34, the openings 22 of the manifold assembly 20 are configured to lie over corresponding openings 40 in the sole plate 34. Thus, dust and dirt debris may be drawn unimpeded through the openings 40 in the sole plate 34 and openings 22 of the manifold assembly 20 when the cleaning tool 10 is assembled.

The manifold assembly 20 and sole plate 34 provide further advantages in that both are removable. This enables manifolds and sole plates having slightly varying configurations to be easily substituted to tailor the speific airflow characteristics of the cleaning tool 10 to meet the needs of different cleaning applications. The removability of the manifold assembly 20 and sole plate 34 further provides significant manufacturing advantages in that the same T-shaped main housing 12 (as well as many other components) may be used in constructing several different cleaning tools having slightly different manifold assemblies, and sole plate components.

FIG. 2 also illustrates an optional short bristled brush 43 adapted to be secured in a slot 45 within the sole plate 34, and an optional floor brush 42. The floor brush 42 together with brush carriage plates 44 and a manually actuatable camshaft 46 may be incorporated into the cleaning tool 10 to provide a selectively positionable brush to further aid in loosening dust and dirt debris from carpeted or cloth covered surfaces. The floor brush 42 is adapted to circumscribe the head portion 36 of the sole plate 34. Brush carriage plates 44 are adapted to engage via tabs 48 within outermost opposing ends of the floor brush 42. Springs 50 are included for resting over bosses 51 protruding outwardly from the sole plate 34 and providing an upward biasing force against the undersurfaces of the brush carriage plates 44. The springs 50 operate to hold the floor brush 42 up and off of the surface being cleaned when the floor brush 42 is in its stored position.

To lower the floor brush 42, the camshaft 46 includes a lever portion 52 which protrudes through a semi-annular opening 54 in the head portion 14 of the main housing 12. Adjacent the semi-annular opening 54 are shoulder portions **56*a* and 56*b* which act as "stops" for the cam lever 52 when the camshaft 46 is rotated to lower the floor brush 42. Further attached to the camshaft 46 are cam lobes 58 which reside over brush carriage plates 44. The cam lobes are further configured on the camshaft 46 in relation to the cam lever 52** to provide an "over-center" locking action, which will be explained below.

To cause the floor brush 42 to lower against the bias force of the springs 50, the cam lever 52 is rotated towards shoulder portion **56*a*. This causes the cam lobes 58 to forcibly abut the brush carriage plates 44 and force the plates 44 downward against the bias force provided by springs 50, thereby causing the floor brush 42 to lower. As the cam lobes 58 pass the "center" or vertical position, the bias force of the springs 50 pushes the cam lobes 58 axially upward until the shoulder portion 56*a* of the main housing 12 interrupts the rotation of the cam lever 52. The floor brush 42 will then be held in a lowered position as a result of contact between the cam lever 52 and shoulder portion direction 56*a* of the main housing 12. To raise the floor brush 42, the cam lever 52 is rotated in an opposite axial direction, i.e., away from shoulder portion 56*a*, thereby allowing the brush carriage plates 44 and the attached floor brush 42 to be forced upwardly by the springs 50. It should be appreciated, however, that the floor brush 42 is optional and that the cleaning tool 10** will work well without it.

Further included in FIG. 2 is the optional pivot arm assembly 26. This assembly generally includes a pivot arm 60, pivot arm bushing 62, pivot arm wheels 64 and axles 66. The pivot arm 60 includes a generally annular pivot section 68 having a plurality of apetures 70 in its ends and a generally rectangular opening 72. The pivot section 68 is coupled to a transverse barrel portion 74 which is in turn coupled to a tubular end portion 76 having a generally square shaped outer surface. The pivot arm bushing 62 is secured, preferably by ultrasonic welding, to the tubular end portion 76 to provide a means by which the extension wand 28 (shown in FIG. 1) may be secured to the pivot arm 60. The rectangular opening 72 enables air to flow through the pivot arm 60 as the pivot arm 60 is rotated during use of the cleaning tool 10. The pivot assembly 26 generally enables the cleaning tool 10 to be rotated vertically along a partial arcuate path to facilitate articulation of the tool 10 during use on non-planar surfaces.

The axles 66 of the pivot arm assembly 26 are positioned through the apertures 70 in the pivot section 68 and snappingly engage boss portions 78 inside each wheel 64. When assembled, the wheels 64 protrude outwardly from semi-circular cut-out sections 80 and 82 of the base portions 16 and 38 of the main housing 12 and sole plate 34 respectively. Axles 66 rest partially within the enclosure formed by the coupling sections 33 and 35 and within semi-arcuate cut-out portions 84. In addition to allowing pivotal movement of the cleaning tool 10, the wheels 64 also operate to absorb the majority of downward force placed on the tool by the extension wand 28 during use of the tool 10.

Figure 3:
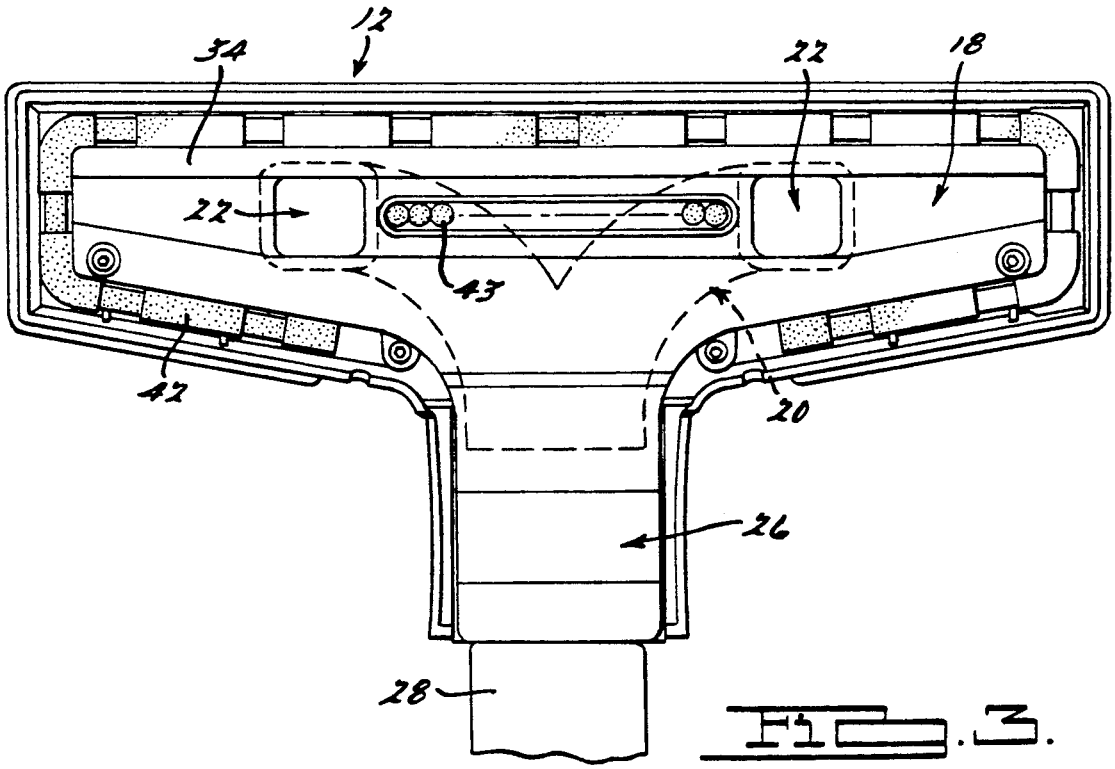
FIG. 3 is a plan view of the undersurface of the cleaning tool.
Figures 4, 5, 6:
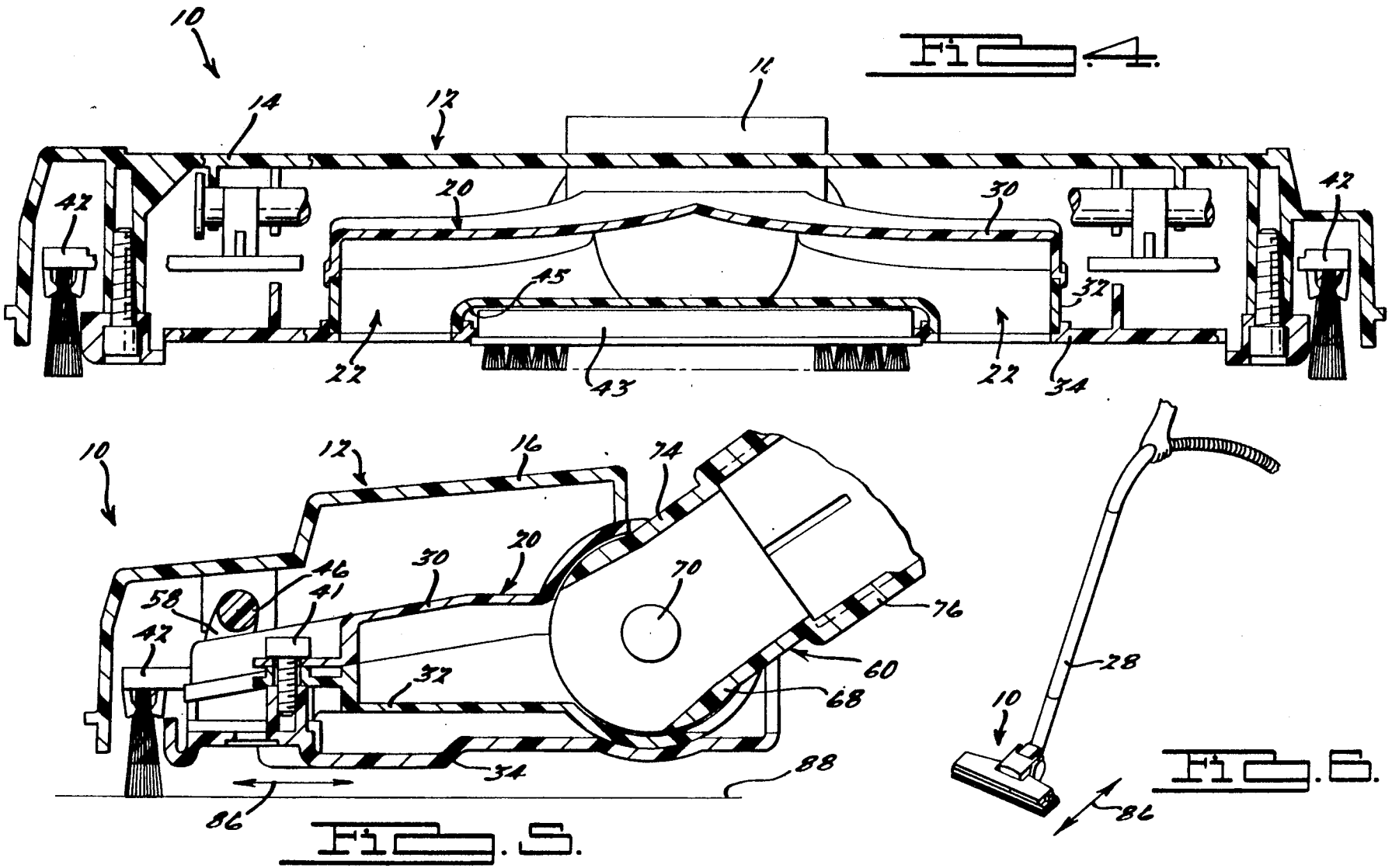
FIG. 4 is a sectional view of the cleaning tool taken along sectional lines 4—4 of FIG. 1.
FIG. 5 is a sectional view of the cleaning tool taken along sectional lines 5—5 of FIG. 1.
FIG. 6 is a perspective view of the cleaning tool showing how it may be manually operated.

Referring to FIGS. 3–5, the manifold assembly 20 is shown in various views to further illustrate its orientation within the housing 12. With specific reference to FIGS. 3 and 4, the relationship of the openings 22 in the manifold assembly 20 with respect to the lower surface 18 of the cleaning tool 10 can be seen more clearly. In FIG. 5, the pivot arm 60 is shown more clearly in assembly relation with the base portion 16 of the housing 12 and with the upper and lower manifold sections 30 and 32, respectively.

The operation of the cleaning tool 10 can best be understood with reference to FIGS. 5 and 6. The tool is operated by manually traversing it in "front-to-back movements", as indicated by directional arrow 86, over a surface 88 to be cleaned. The brush 42 helps to lift dust and dirt particles from the surface 88. Air passageways 24 provide a more uniform distribution of vacuum force across the undersurface 18 of the tool 10 resulting in a more effective pick-up of dust and dirt particles.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A cleaning tool for a vacuum cleaner system, said cleaning tool comprising:

a housing;

a removable lower sole plate operatively associated with said housing and forming an undersurface of said housing, said lower sole plate having a plurality of openings therein;

an independently formed, removable, manifold disposed within said housing, said manifold having a plurality of independent, elongated air passageways, said air passageways each having an outermost end with each said outermost end having at least one opening forming an intake port, each said intake port being in communication with one said opening of said lower sole plate, whereby said lower sole plate operates to help restrict a vacuum airflow through only those areas defined by said intake ports, said manifold thereby being operable to evenly distribute said vacuum airflow across said undersurface of said cleaning tool to help facilitate vacuum pick-up of dust and dirt particles.

2. The cleaning tool of claim 1, wherein said cleaning tool further comprises means for allowing said cleaning tool to pivot vertically in a partially arcuate path, thereby helping facilitate articulation of said cleaning tool during use thereof.

3. A cleaning tool for a vacuum cleaner system, comprising:

a T-shaped housing;

a removable lower sole plate operatively associated with said housing and forming an undersurface of said housing, said lower sole plate having at least one opening; and an independently formed, removable manifold disposed within said T-shaped housing, said manifold having a plurality of independent, elongated air passageways, said plurality of independent, elongated air passageways each having an outermost end which forms a port, at least one of said ports being in coaxial alignment with said opening in said sole plate, said independent, elongated air passageways and said ports being operable to evenly distribute a vacuum force produced by said vacuum cleaner system through said independent, elongated air passageways and through said openings, thereby helping to facilitate pick-up of dust and dirt particles through said first apertures.

4. The cleaning tool of claim 3, wherein said housing further comprises a pivot arm assembly operable to enable said housing to move in a partially arcuate path relative to said undersurface of said housing.

5. A vacuum cleaner system cleaning tool comprising:

a T-shaped main housing member and a T-shaped lower sole plate member, said lower sole plate member having a plurality of openings disposed therein, said main housing member and said lower sole plate member being adapted to abuttingly engage each other to form a housing assembly; and upper and lower manifold portions, said lower manifold portion having a plurality of manifold ports therein, said upper and lower manifold portions being adapted to abuttingly engage each other to form a manifold assembly, said manifold assembly being disposed within said housing assembly so as to place said manifold ports in alignment with said openings in said lower sole plate member;

wherein said manifold assembly is operable to selectively direct a vacuum force to said ports to thereby evenly distribute said vacuum force across said loaer sole plate member, thereby helping facilitate pick-up of dust and dirt particles by said cleaning tool.

6. The vacuum cleaner system of claim 5, further comprising a pivot arm adapted to partially reside within a portion of said housing assembly and operable to couple said manifold assembly with an extension wand, said pivot arm being operable to allow said housing assembly to rotate vertically in a partially arcuate path relative to said extension wand and to enable said vacuum force to pass therethrough.

7. The vacuum cleaner system of claim 5, further comprising a floor brush circumscribing said lower sole plate member, said brush being operable to help loosen said dust and dirt particles on surfaces being cleaned.

* * * * *